United States Patent [19]

Griffin

[11] 4,295,319

[45] Oct. 20, 1981

[54] FLOOR PANEL

[75] Inventor: Kary A. Griffin, Dallas, Tex.

[73] Assignee: G. H. Products, Inc., Dallas, Tex.

[21] Appl. No.: 90,018

[22] Filed: Oct. 31, 1979

[51] Int. Cl.[3] ..... E04B 2/28

[52] U.S. Cl. ..... 52/785; 52/802

[58] Field of Search ..... 52/126, 802, 805, 804, 52/785, 803

[56] References Cited

U.S. PATENT DOCUMENTS

| | | | |
|---|---|---|---|
| 2,008,325 | 7/1935 | Holbrook | 52/805 |
| 2,278,331 | 3/1942 | Meyercord | 52/805 |
| 3,150,748 | 9/1964 | Liskey | 52/126 |
| 3,180,460 | 4/1965 | Liskey | 52/126 |
| 3,236,018 | 2/1966 | Graham | 52/802 |
| 3,396,501 | 8/1968 | Tate | 52/126 |
| 3,443,349 | 5/1969 | Mahle | 52/126 |
| 3,470,663 | 10/1969 | Tate | 52/126 |
| 3,548,559 | 12/1970 | Levine | 52/619 |
| 3,568,390 | 3/1971 | Swensen | 52/805 |
| 3,696,578 | 10/1972 | Swensen | 52/126 |
| 4,067,156 | 1/1978 | Downing | 52/126 |
| 4,074,488 | 2/1978 | Ray | 52/126 |
| 4,085,557 | 4/1978 | Thap | 52/126 |
| 4,113,219 | 9/1978 | Mieyal | 248/354 |

FOREIGN PATENT DOCUMENTS

| | | | |
|---|---|---|---|
| 88656 | 3/1967 | France | 52/802 |
| 90081 | 8/1967 | France | 52/802 |
| 715083 | 9/1954 | United Kingdom . | |

*Primary Examiner*—Price C. Faw, Jr.
*Assistant Examiner*—Henry E. Raduazo
*Attorney, Agent, or Firm*—Kanz & Timmons

[57] ABSTRACT

A floor panel for use in elevated floor assemblies having a bottom metal sheet and a top metal sheet sandwiched on each side of a solid noncompressible core. The bottom has an upwardly turned side deflected away from the side of the core forming a first shoulder on the upper edge thereof and the top has a downwardly deflected side spaced from the first shoulder forming a second shoulder such that they are spaced, non-overlapping sides. A flexible edge member having an outer shoulder engaging the first shoulder of said bottom metal sheet and an inner channel formed longitudinally thereof to receive the downwardly deflected edge of the top metal sheet is wedged between the top metal sheet edge and the bottom metal sheet edge and is locked in by the first and second shoulder on the bottom and top sheet respectively. Further, an abuttment surface formed on the outer and inner edges adapted to abutt the inner edge of the bottom metal sheet and the side of the noncompressible core so as to limit rotation from torsional forces applied to the outer flexible edge member of the floor panel.

4 Claims, 2 Drawing Figures

FLOOR PANEL

DESCRIPTION

1. Technical Field

My invention relates to a floor panel which is used to provide an elevated floor system mounted on pedestals which provide an access area under the floor.

Raised access floors are often used to reduce the cost of concealing cables, piping, conduits and air conditioning associated with computer rooms, hospitals, office areas, communication rooms, control rooms and remodeling jobs. Further, it allows access later for updating of the equipment and rerouting of cables. The panels must be strong enough to support the heavy concentrated weights of the electronic equipment and operating personnel. The panels allow for removal and for installing new equipment or updating old equipment.

2. Background Art

Prior art U.S. Pat. No. 3,548,559 discloses a floor panel having an upper planar surface and a bottom surface having flanges turned upwardly with a flexible edge member disposed between the flanges and the planar top. The edge member has a tendency to turn to the outside thus deforming and possibly slipping out of the floor panel.

Other prior art, disclosed in U.S. Pat. No. 3,236,018, discloses a hollow metallic floor panel having an edge member which extends over the flange of the bottom member. The top portion of the panel is slidably disposed within the bottom member and thus must be precision made and welded together. The edge member is held only by the tread surface and may easily rotate about the upper edge of the flange thus deforming and possibly slipping from the edge of the floor panel.

DISCLOSURE OF THE INVENTION

In accordance with the present invention, I provide a flexible edge member having a plurality of shoulders and abutting surfaces which are wedged between opposed spaced flanges of a top metal sheet and a bottom metal sheet formed on opposed sides with solid noncompressible core of a floor panel.

The improved flexible edge member and opposed spaced flanges of the upper and lower ends of the floor panel provide a first shoulder and first abutting surface to prevent rotation toward the outer edge of the floor panel of the flexible edge member. The flexible member has a second shoulder and second abutting surface which prevents inner rotation to deform the flexible edge member and further provides a third shoulder which prevents lifting of the flexible edge member out from between the two opposed spaced flanges of the upper and lower sheets.

A primary object of the invention is to provide an edge member which may be inserted between two opposed, spaced flanges of a floor panel such that the edge member is not easily deformed in such a manner as to cause it to slip from between the two flanges of the floor panel.

A further object of the invention is to provide a floor panel for raised access floors which is capable of supporting heavy electronic equipment.

Other further objects of the invention will become apparent upon studying the detailed description hereinafter following and the drawings next hereto.

BRIEF DESCRIPTION OF DRAWINGS

The details of my invention will be described in connection with the accompanying drawing, in which.

DESCRIPTION OF THE INVENTION

Figure 1:
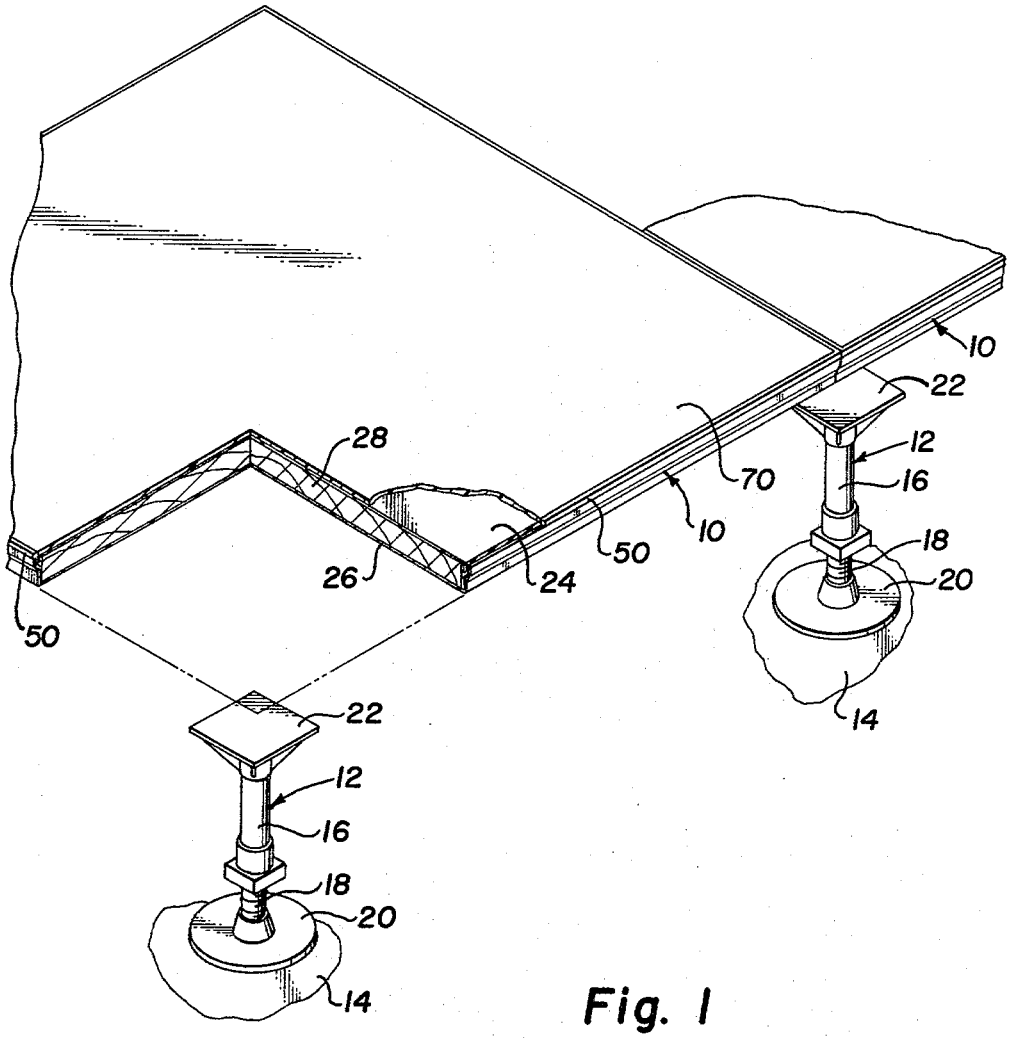
FIG. 1 is a view from the top perspective showing the panel mounted on a typical pedestal and having parts broken away to more clearly illustrate the details of construction.
Figure 2:
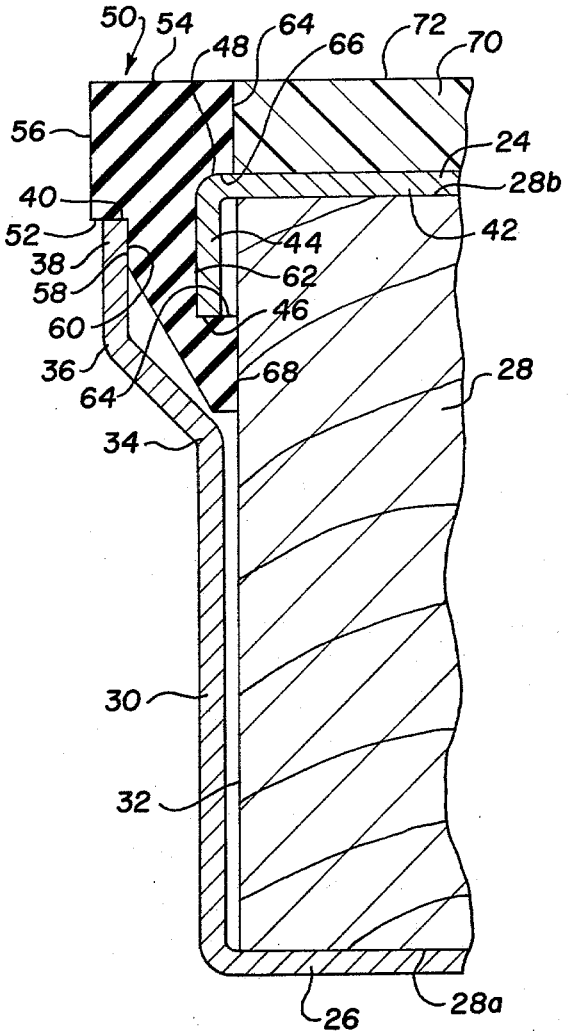
FIG. 2 is a view in section showing the construction details of the edge of the floor panel.

Referring to FIG. 1 and 2, a typical access floor is constructed of floor panels 10 suspended on pedestals 12 over an existing floor 14.

The panels 10 may have the corners suspended on the pedestals 12 or stringers (not shown) may be secured between the pedestals 12 for supporting the entire edge of the panels 10. Pedestals 12 are normally secured to a subfloor 14 by fasteners or adhesives. They are generally adjustable having an upper stem 16 which is threadedly secured to a threaded lower stem 18 secured to base 20. A flat upper head 22 is secured to upper stem 16. Therefore, the overall height between the lower floor 14 and the upper access floor formed by the panel 10 may be adjusted by rotating stem 16 up or down.

Floor panels 10 are generally square in shape or may be rectangular, and generally have an upper metal sheet 24 and a lower metal sheet 26 secured on opposed sides of a noncompressible core 28. The noncompressible core 28 generally comprises a product of wood such as particle board or maybe a solid block of wood. The lower metal section 26 may be secured to the lower side of core 28 by an adhesive such as contact cement. Lower metal sheet 26 has an upwardly deflected side 30 which is spaced from the inner edge 32 of core 28 to allow for manufacturing irregularities. The upper edge of side 30 is deflected at points 34 and 36 to space the upper edge 38 outwardly from the inner edge 32 of core 28. The upper end side 30 forms a first shoulder 40 adjacent to the upper surface **28*b* of core 28**.

The upper metal sheet 24 generally comprises a planar section 42 having a downwardly deflected edge 44, the end of which forms a second shoulder 46. The deflected corner 48 forms a third shoulder on the top metal sheet 24. Edges 38 and 44 are spaced such that they do not engage one another.

A flexible edge member 50 is secured in the open space between the deflected edge 44 of top metal sheet 24 and the deflected edge 38 of bottom metal sheet 26. The flexible edge member 50 is generally t-shaped and constructed of a flexible material such as vinyl or rubber. The flexible edge member 50 has a first outer shoulder 52 formed in the peripheral side 56 just below the upper surface 54. First shoulder 52 is adapted to engage first shoulder 40 of side 30. An outer abutting surface 58 is formed adjacent shoulder 52 and adpated to engage the inner surface 60 of edge 38 of bottom metal sheet 26. An elongated continuous channel or groove 62 is formed on the inner surface 64 longitudinally of flexible member 50 forming a lower shoulder 64 and an upper shoulder 66 on opposed sides of the groove 62. The lower shoulder 64 is adapted to engage the inner second shoulder of top metal sheet 24 and the upper shoulder 66 is adapted to engage corner 48 of the upper metal sheet 24. An inner flat abuttment surface 68 is formed just below the groove 62 and is adapted to engage the surface edge 32 of core 28.

A tread material such as vinyl, rubber, tile, or carpet having a thin thickness is inserted on the upper metal sheet 24 inside of surface 64 of edge member 50. The upper surface 72 of tread material 70 and upper surface 54 of edge member 50 are preferred to be coplanar as illustrated.

From the foregoing it should be readily apparent that flexible edge member 50 is wedged between the two spaced opposed edges 38 and 44 of the lower member 26 and upper member 24 respectively. As pressure is applied to the upper surface 54 by man or machinery, a torsional force in a counter-clockwise direction is resisted by shoulder 52 engaging first shoulder 40 of edge member 38 and abutting surface 68 abutting the surface 32 of core 28. Further, the lower shoulder 64 of groove 62 engages the lower shoulder 46 of edge 44 to resist upward movement to the counter-clockwise torsional forces. Clockwise torsional forces are likewise resisted by corner 48 engaging shoulder 66 of groove 62 and abutting surface 36 engaging surface 60 of edge 38 to prevent deformation of the edge member 50 to such an extent that it would collapse or be expelled from the spaced edges 38 and 46. It is preferred that edge 32 be spaced inwardly from side 30 and edge 44, the upper and lower members to allow for expansion of the wood product and manufacturing tolerances which are more difficult to maintain with wood products. Therefore, from the foregoing it should be readily apparent that a highly dense structure matter capable of withstanding high forces from weight placed on it has a uniquely designed edge member 50 which resists torsional forces which tend to expel an ordinary wedge-type edge member from the edge of the material.

The floor panels 10 are independently placed on the pedestals 12 or other supports and are easily removable and replaceable for access to the area below.

It should be readily apparent from the foregoing that the invention accomplishes the object of the invention herebefore discussed.

It should further be apparent that other and further embodiments of the invention may be devised without departing from the basic concept thereof.

I claim:

1. A floor panel for use in elevated floor assemblies, the panel comprising:

a noncompressible solid core having a side;

a bottom metal sheet having an upwardly deflected edge formed about a periphery of the bottom, the edge forming a first shoulder;

a top metal sheet having a downwardly deflected edge, said edge spaced from the side of said core and inwardly of said first shoulder, said edge further forming a second shoulder, and said top metal sheet and bottom metal sheet being positioned on opposed sides of said core; and a flexible edge member having an outer shoulder engaging said first shoulder on said bottom metal sheet and an inner channel formed in said flexible edge member having an upper inner shoulder engaging the upper surface of said top metal sheet and a lower inner shoulder engaging said second shoulder of said top metal sheet, the channel receiving said deflected edge of said top metal sheet to prevent rotation of the flexible edge member, said flexible edge member being wedged between the upward deflected edge of the bottom metal sheet and the downward deflected edge of the top metal sheet, and said flexible edge member further having an abuttment surface formed adjacent said channel and lower inner shoulder, the abuttment surface having a substantially flat, wide surface preventing inward rotation of the edge member to engage a side of said core.

2. A floor panel according to claim 1, including a tread material secured to the top metal sheet, the upper surfaces of said tread material and flexible edge member being coplanar.

3. A floor panel according to claim 1, including an adjustable pedestal comprising:

a base having an upwardly extending treaded stud;

a hollow tubular upper member having a threaded passage adapted to move over said treaded stud of said lower base;

a head adapted to support a corner of said floor panel.

4. A floor panel for use in elevated floor assemblies, the panel comprising:

a noncompressible solid core having a side along the periphery thereof;

a bottom metal sheet having an upwardly extending edge formed about the periphery thereof, said upwardly extending edge further being deflected outwardly from the side of said core and the upper edge thereof forming a first shoulder;

a top metal sheet having a downwardly extending edge, said edge spaced from said core and inwardly of said first shoulder, the outer end of said edge further forming a second shoulder, said top metal sheet and bottom metal sheet being positioned on opposed sides of said core and secured thereto by adhesive; and a flexible edge member having an outer shoulder engaging said first shoulder of said bottom metal sheet, a first abuttment surface formed adjacent said outer shoulder to engage the inner surface of the edge of said bottom metal sheet, said flexible edge member further having a continuous channel formed longitudinally thereof having an upper shoulder to engage an upper corner of said top metal sheet and a lower shoulder to engage said second shoulder on said top metal sheet, the channel receiving said deflected edge between the upper and lower shoulder to prevent upward movement of said flexible edge member, said flexible edge member further having a second abuttment surface immediately adjacent said lower shoulder of said channel having a substantially flat, wide surface engaging the side of said core to prevent inward rotation of the edge member.

* * * * *